United States Patent [19]

George

[11] 4,036,432

[45] July 19, 1977

[54] VARIABLE SPEED FAN DRIVE SYSTEM

[76] Inventor: Albert L. George, P.O. Box 3604, Lafayette, La. 70501

[21] Appl. No.: 628,125

[22] Filed: Nov. 3, 1975

[51] Int. Cl.[2] ..... F01P 7/02

[52] U.S. Cl. ..... 236/35; 60/445; 165/39; 417/213

[58] Field of Search ..... 236/35, 38; 165/39; 417/213; 60/445, 456, 486

[56] References Cited

U.S. PATENT DOCUMENTS

| | | | |
|---|---|---|---|
| 2,166,940 | 7/1939 | Conradson | 60/329 |
| 2,276,895 | 3/1942 | Vosseler et al. | 60/486 UX |
| 3,808,813 | 5/1974 | Spinks | 60/486 |

FOREIGN PATENT DOCUMENTS

| | | | |
|---|---|---|---|
| 1,067,557 | 1/1965 | United Kingdom | 60/456 |

*Primary Examiner*—William E. Wayner
*Attorney, Agent, or Firm*—Pravel, Wilson & Gambrell

[57] ABSTRACT

A variable speed drive system for driving one or, preferably, a plurality of fans at a desired, controllable speed. The fans are rotated by motors in fluid communication with variable displacement pumps. The motors rotate the fans at a speed corresponding to the fluid displacement of the pumps and an adjusting structure operably connected to the pumps regulates the fluid displacement of the pumps so that the fans are driven by the motors at a desired speed. Preferably, the adjusting structure includes a temperature sensor and a pump displacement control responsive to the temperature sensor so that the fluid displacement of the pumps is automatically regulated in response to the temperature of the substance cooled by the fans.

1 Claim, 4 Drawing Figures

VARIABLE SPEED FAN DRIVE SYSTEM

BACKGROUND OF THE INVENTION

The field of this invention is variable speed fan drive systems and the like.

In the transportation of natural gas it frequently becomes necessary to increase the pressure of the gas in the gas transmission line to facilitate movement of the gas along the transmission line. Reciprocating piston and rotary compressors are commonly used to compress the gas and increase its pressure. This operation generates large amounts of heat which need to be dissipated. When the gas is compressed, its temperature increases appreciably. Additionally, heat must also be dissipated from the compressor cooling water and engine lubricants. One way in which heat is dissipated from the gas, lubricants, and cooling water is to pass those substances through separate finned, multiple tube banks and circulate air over the exposed areas of these finned tubes. Heat is thus transferred from the gas, lubricants, and cooling water, through the finned tubes, and to the environment.

Rotating fans are used to circulate air around the finned tubes. These fans are driven by a drive means, the power for which can be derived from the main compressor prime mover or from some external source. Regardless of its source, however, the power is transmitted to the fans through mechanical, electrical or hydraulic drives.

Several disadvantages were associated with known fan drive systems. Typically, they were not easily adjustable to vary the amount of air the fans passes over the finned tubes to account for ambient temperature differences between seasons. With many known fan drive systems, to adjust the amount of air passed over the finned tubes, it was necessary to shut down the compressor which served as the prime mover for the drive system and to manually change the pitch of the fan blades. This process was undesirable not only because it caused an interruption in the gas compressor output, but also because the adjustments resulted in a waste of energy. Adjusting the pitch of the fan blades merely amounted to spilling a part of the horsepower developed by the compressor in order to set the fan speed. This spilling of the excess horsepower was, of course, a waste of energy. Spilling the horsepower from the compressor also reduced the amount of compressor horsepower available to accomplish the work of compressing gas.

Further, with mechanically driven systems, the location of the fan drive means relative to the prime mover was severely limited.

SUMMARY OF THE INVENTION

It is an object of this invention to provide a new and improved fan drive system.

The variable speed fan drive of the present system is particularly adapted for use as a part of the cooling apparatus in gas transmission line compressor stations where substances are passed through finned tube banks and fans circulate air over tube banks to dissipate heat from the substances. The fan drive system of the present invention includes variable displacement pump means and adjusting means to regulate the fluid displacement of the pump means. Fan motor means in fluid communication with the pump means rotate the fans at a speed corresponding to the fluid displacement of the pump means. With this structure, the amount of air circulated over the tube banks and, hence, the amount of cooling of the substances in the tube banks is regulated by controlling the speed at which the fans are rotated. The fan speed, in turn, is controlled by regulating the fluid displacement of the pump means. Variation of the fluid displacement of the pump means may be accomplished while the prime mover of the pump means is engaged. Accordingly, where the gas compressor is used as the pump prime mover, it is unnecessary to shut down the compressor to accomplish an adjustment of the fan output. There need be no interruption of the compressor station functions to accomplish an adjustment of the fan output. Further, unlike many fan drive systems which permitted adjustment of the fan output simply by adjusting the pitch of the fan blades, a decrease in the fan output of the present system does not amount simply to a spillage of energy from the gas compressor. When the fan speed is reduced by reducing the fluid displacement of the pump means, there is also a reduction in the horsepower drawn from the gas compressor by the pump. Accordingly, with the structure of the present invention, a decrease in the fan speed not only amounts to a saving of energy when compared with known systems, but also diverts less horsepower from the gas compressor so that more compressor horsepower is available to accomplish the task of actually compressing gas.

Preferably, the adjusting means of the present invention includes a temperature sensor for sensing the temperature of the substances in the finned tube banks and a pump displacement control means response to the temperature sensor. With this structure, the fluid displacement of the pump means is automatically regulated in response to the temperature of the substance cooled by the fans. This automatic adjusting structure ensures that the amount of air circulated by the fans is sufficient to accomplish the cooling requirements of the system. Further, the automatic adjusting structure reduces or eliminates the energy waste associated with known, manually adjusted fan drive systems which were set for the greatest expected cooling requirements of the system over prolonged time periods. The automatic adjusting structure of the present invention also reduces the expenditures of time, money, and manpower required to manually adjust such known systems. For example, the fan drive system of the present invention automatically adjusts the output of the fan to accommodate the differentials in ambient temperature due to the changing daily and seasonal temperature conditions. The structure also, of course, automatically adjusts for differing cooling requirements dictated by the quantity of gas being compressed at the compressor station.

According to a preferred embodiment of the present invention, a plurality of fans are driven by associated fan motors and a plurality of pumps with the necessary interconnecting hydraulic structures are provided. At least one of the pumps has a fluid output capacity greater than that required to drive one fan motor, and the system may be provided with cross-over valves and pressure equalization structures so that less than the total number of pumps or even a single pump may be utilized to drive the plurality of fans at a desired speed. This structure permits the continued driving of the plurality of fans at the desired speed while a pump is being tested or even in the event of the failure of one of the pumps. Further, when the cooling requirements of the system are sufficiently low that it is more economical to operate less than the total number of pumps, the structure of the system of the present invention permits such operation.

This preferred embodiment of the present invention permits all fans to be driven at desired speed by one or more pumps while compressor prime mover speeds change and this is accomplished without spilling horsepower and without interruption of compressor operation.

The fluid communication between the variable displacement pumps and the fan drive motors allows freedom of placement of finned tubes and fans relative to prime mover drive shaft thus providing better space utilization on offshore structures where space is a premium.

DETAILED DESCRIPTION OF THE PREFERRED EMBODIMENTS

Figure 1:
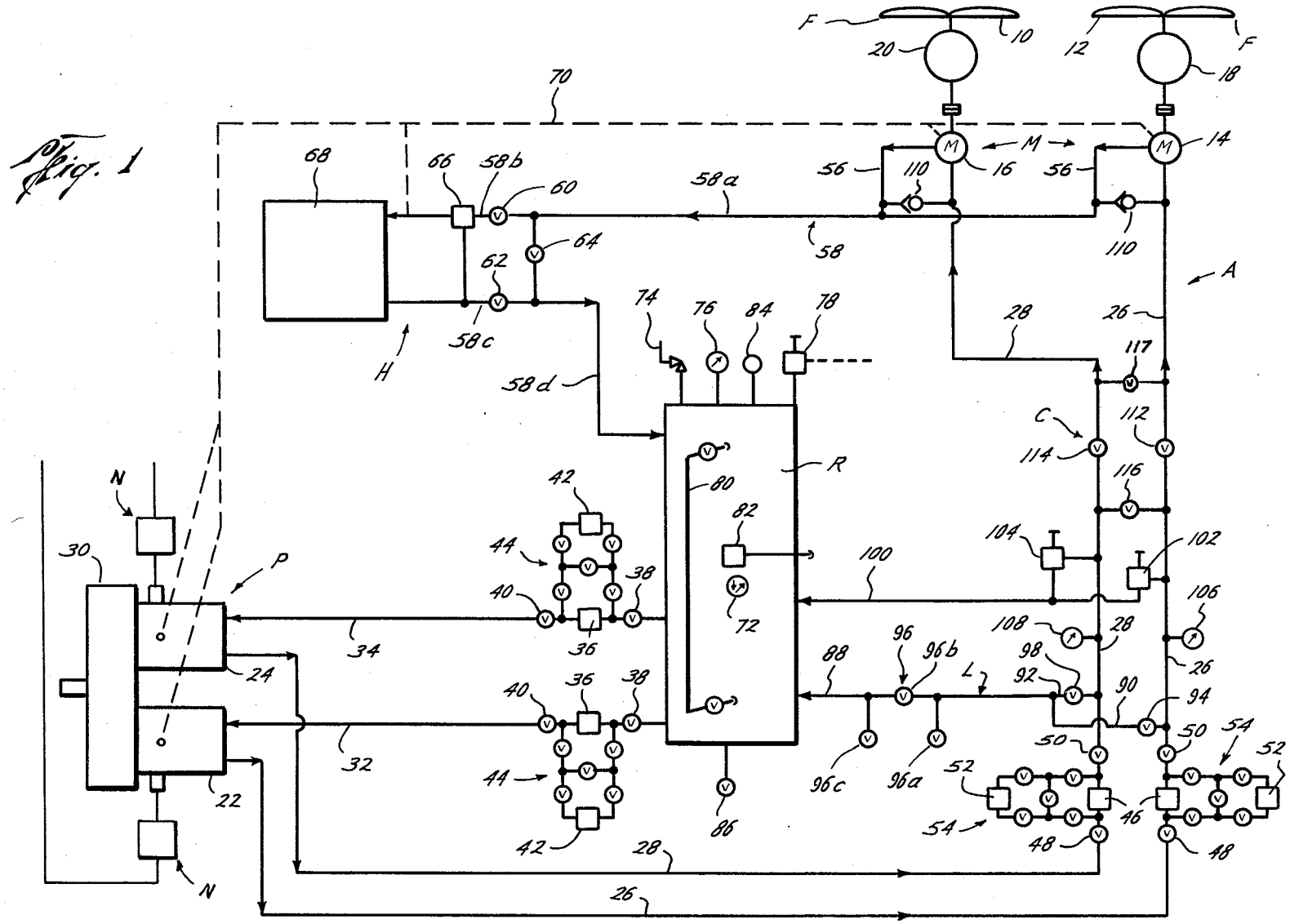
FIG. 1 is a schematic representation of the fan drive system of the present invention.

In the drawings, the letter A designates generally the fan drive system of the present invention which includes pump means P for drawing fluid from a hydraulic reservoir R and supplying fluid to fan motor means M. The fan motor means M rotates fans F, causing air to circulate over a finned tubed bank T (FIG. 2) to dissipate heat from the substances flowing through the finned tube bank T.

Considering the invention in more detail, FIG. 1 illustrates a preferred embodiment of the present invention in which a pair of fans 10 and 12 are driven by the fan drive system A. Hydraulic motors 14 and 16 are operably connected to fans 12 and 10, respectively, through separate gearbox assemblies 18 and 20 to drive the fans 12 and 10 when the motors 14 and 16 receive a suitable supply to hydraulic operating fluid. A pair of pumps 22 and 24 are placed in fluid communication with motors 14 and 16 by conduits 26 and 28 so that a supply of operating hydraulic fluid is supplied to the motors 14 and 16. The pumps 22 and 24 are driven in a conventional manner through a double pump drive gearbox 30 which receives power from a gas compressor or other suitable prime mover.

When so driven, pumps 22 and 24 draw hydraulic fluid from reservoir R through conduits 32 and 34, respectively. Each of the conduits 32 and 34 has a suction filter 36 in the conduit between reservoir R and the respective pump to filter foreign matter from the hydraulic fluid drawn from the reservoir R by the pumps. A pair of blocking valves 38 and 40 are also provided in each of the conduits 32 and 34 on opposing sides of the suction filters 36 so that the filters 36 may be isolated from the fluid flow in system A for maintenance and repair purposes. It should be understood, however, that blocking valves 38 and 40 are normally open and allow free fluid flow in conduits 32 and 34 during the normal operation of the fan drive system A.

A differential pressure indicating switch 42 is additionally connected across each suction filter 36 through a five valve assembly 44. The five valve assemblies 44 are connected to the conduits 32 and 34 on opposing sides of the filters 36 and between the blocking valves 38 and 40 so that when the blocking valves 38 and 40 are used to isolate the suction filters 36, the differential pressure indicating switch 42 and its associated five valve assembly 44 are also isolated. During normal operation of system A, however, the differential pressure indicating switch 42 senses the pressure differential across its associated suction filter 36 to provide a monitor for that pressure differential. The differential pressure indicating switch 42 may visually display the pressure differential across the suction filter 36 and also provide a warning signal to an alarm system (not shown) when the pressure differential across filter 36 exceeds designated limits, indicating that the filter has become clogged or has otherwise malfunctioned.

The five valve assembly 44 is preferably a single manifold five valve assembly such as is available from Hoke Incorporated of Cresskill, New Jersey. However, the five valve assembly may also comprise five blocking valves arranged in the manner illustrated in FIG. 1. Such a valving arrrangement is conventional in nature, and is used to provide a valving network by which suction filter 36 may be bypassed, pressure indicating switch 42 may be bypassed, or an artifical pressure differential may be exerted on the Test loop structure L is also provided between the reservoir R and the pump discharge conduits 26 and 28. A main test loop conduit 88 extends from the reservoir R and joins branch conduits 90 and 92 which permit the pump discharge conduits 26 and 28 to be brought into fluid communication with the conduit 88. A blocking valve 94 in conduit branch 90 is closed during normal operation of the system A. However, for testing purposes, blocking valve 92 may be opened to provided a flow passage between the pump discharge conduit 26 and a test loop valve network 96. Blocking valve 98 is closed during normal operation of the system A, but for testing purposes may be opened to provide a fluid passageway between the pump discharge conduit 28 and the test valve network 96. The test valve network 96 consists of three blocking valves, **96*a*, 96*b*, and 96*c*. To test the performance of pumps 22 or 24, a test meter (not shown) is connected between valves 96*a* and 96*c*. To check fluid flow through pump discharge conduit 26, valve 96 is opened, valve 96*a* is opened, valve 96*b* is closed, valve 96*c* is opened and valve 112 is closed thus directing total flow from pumps 22 through test loop 96, and test meter (not shown) through conduit 88 to reservoir R. By opening valve 117, both fan motors 14 and 16 will run at full capacity on fluid delivered by pump 24. Similarly, to check the fluid flow through pump discharge conduit 28, blocking valve 98 is opened, valve 96*a* is opened, valve 96*b* is closed, valve 96*c* is opened and valve 114 is closed thus directing total fluid flow from pump 24 through test loop 96, test meter (not shown) conduit 88 and to reservoir R. By opening valve 117, fan motors 14 and 16 will run at full capacity on fluid delivery by pump 22**.

Structure is also provided between the reservoir R and pump discharge conduits 26 and 28 is relieve any excess pressure built up in the pump discharge conduits 26 and 28. A pressure relief conduit 100 extends from reservoir R and is joined with the respective pump discharge conduits through pressure relief valves 102 and 104. Pressure relief valves 102 and 104 are conventional pressure relief valves which are biased to pass fluid only when the fluid pressure on one side of the valve exceeds a certain given threshold pressure. In operation of system A, both valves are set for a certain predetermined threshold pressure, and when the fluid pressure in pump discharge line to which the pressure relief valve is connected exceeds that given threshold pressure, the pressure relief valve allows the fluid to flow from the pump discharge conduit to the reservoir R. Pressure gauges 106 and 108 are provided in the pump discharge conduits 26 and 28 upstream of the pressure relief valves 102 and 104 to provide a visual display of the pressure in the lines so that an operator of system A can determine that the respective pressure relief valves are functioning properly.

Fluid flowing through the pump discharge conduits 26 and 28 to the motors 14 and 16 cause the motors to rotate at a speed proportional to the rate at which fluid is introduce into the motors from the conduits. The motors 14 and 16 thus rotate their associated gearbox assemblies 18 and 20 and the fans F so long as hydraulic fluid is supplied to the motors. When the system A is to be shut down, rotation of the fan is terminated by interrupting the fluid supply to the motors 14 and 16. However, the motors M will continue to rotate for a short period of time due to inertia. During this transitional period of shutdown, it is undesirable to interrupt all fluid supply to the motors 14 and 16 because of the undue wear and overheating which would occur if they were permitted to rotate without any fluid intake. Accordingly, each of the motors 14 and 16 is provided with an overrun control valve 110 operably connected between the motor discharge conduit 56 and the pump discharge conduit associated with that motor. The overrun control valves 110 function substantially as a check valve, permitting fluid flow from the motor discharge conduit 56 to the respective pump discharge conduit when the pressure in the motor discharge conduit exceeds the pressure in the pump discharge conduit. During transitional shutdown of the system A, removal of the fluid pressure in the pump discharge conduit opens the overrun control valve 110 and permits fluid to flow from the motor discharge conduit 56 to the pump discharge conduit and thus provide a fluid intake for the motor M until the inertia movement of the motor has been disipated.

A additional feature of the fan drive assembly A should also be noted at this point. A cross-over valve network C is provided in the pump discharge conduits 26 and 28. The cross-over valve network includes a blocking valve 112 mounted in pump discharge conduit 26, a blocking valve 114 mounted in pump discharge conduit 28, and a blocking valve 116 mounted between conduits 26 and 28 and upstream of the blocking valve 112 and 114, and a blocking valve 117 downstream of the blocking valves 112 and 114. During normal operation of the system A, the blocking valves 116 and 117 are closed and blocking valves 112 and 114 are both open. However, in a preferred embodiment of the present invention, at least one of the pumps 22 or 24 has a sufficient fluid output capacity to supply both of the fan motors 14 and 16. For example, for maintenance, repair or maximum energy conservation, it may be desirable to have one of the pumps drive both of the fan motors 14 and 16. To accomplish this end, blocking valve 117 is opened so that fluid supply from either pump discharge conduit 26 or 28 is introduced to both motors 14 and 16. To ensure that fluid does not flow upstream and away from the motors, blocking valve 112 or 114 may be utilized to close the pump discharge conduit connected to the pump which is to be idled. Further, the crossover valve system C permits either of the pumps 22 or 24 to drive either of the fan motors 14 or 16. For example, when it is desired to idle pump 24 and fan 12 and also to have pump 22 to drive fan motor 16 and fan 10, blocking valve 112 may be closed and blocking valve 116 opened to provide an appropriate fluid supply from pump 22 to motor 16. When the system is utilized in this manner, the valve 50 in pump discharge conduit 28 may be closed to ensure that fluid does not flow upstream away from fan motor 16. It should be understood, of course, that additional fluid supply passages from the respective pumps and to the respective fan motors can be completed utilizing the crossover valve system C. With the valve system C, maintenance and repair of the fan drive assembly A is possible without necessitating a shutdown of the entire system. Thus, fan drive system A provides a reliable, safe, and efficient means for driving fans to achieve cooling in a gas transmission line compressor station.

Additionally, however, fan drive system A is adjustable to meet the varying cooling requirements encountered at the gas transmission line compressor station. As previously noted, motors 14 and 16 rotated the fans 10 and 12 through the respective gearbox assemblies 18 and 20 at rate corresponding to the fluid displacement of the pumps 22 and 24. With the present invention, pumps 22 and 24 are variable displacement pumps so that by regulating the displacement of the pumps 22 and 24, the speed at which the fans 10 and 12 rotate is controlled. Pumps suitable for use with the system A include the PV 3200 pressure compensator variable displacement pump and the PV 3250 constant volume control variable displacement pump available from Delavan Manufacturing Company in Des Moines, Iowa. It should be emphasized, of course, that other types of variable displacement pumps are suitable for use with the system A.

Pumps 22 and 24 are each provided with an adjusting means N for regulating the fluid displacement of the respective pumps by varying the disposition of the a swash plate within the pumps. The adjusting means may be either manually adjusted or temperature responsive, automatically adjusting structures.

Figure 2:
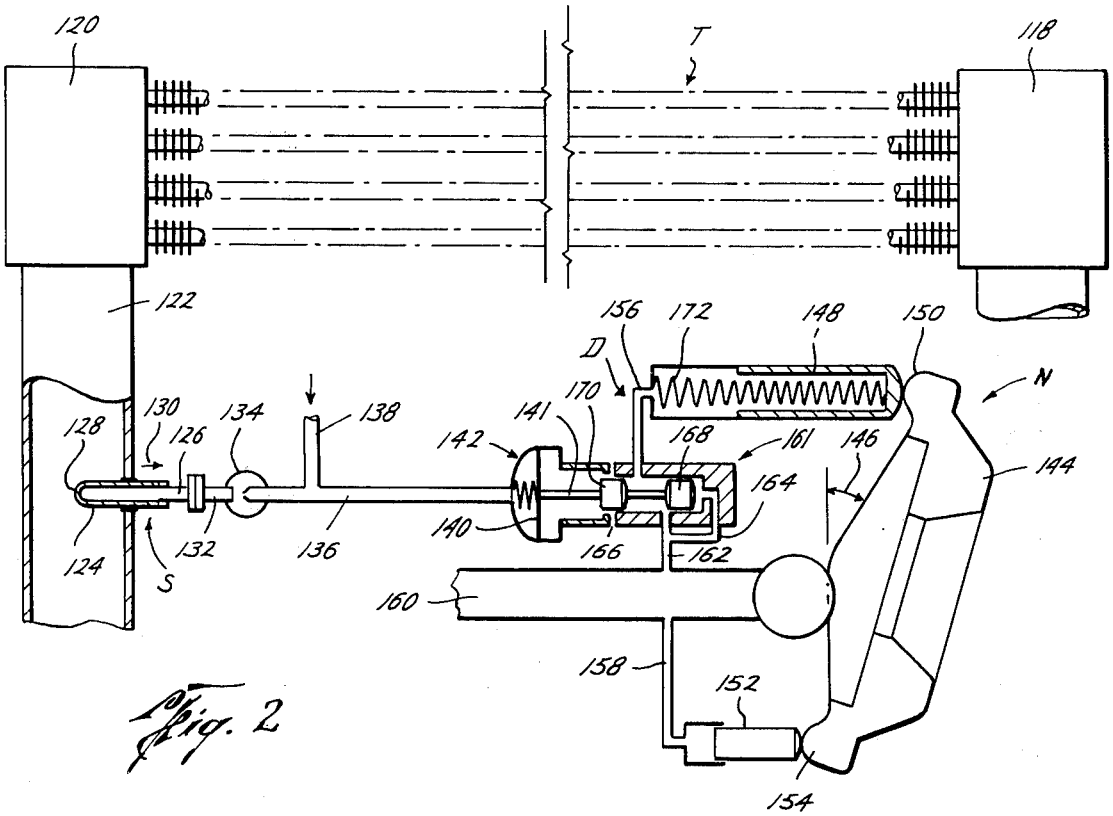
FIG. 2 is a schematic representation of the first embodiment of the temperature sensor and pump displacement control apparatus of the present invention.

In a preferred embodiment of the present invention, the adjusting means includes a temperature sensor S and a pump displacement control means D response to the temperature sensor. A first embodiment of such an adjustng means is illustrated in FIG. 2. The substances to be cooled at the compressor station are passed into an inlet header 118, through a finned tube bank T, to an outlet header 120 and through a compressor station discharge conduit 122. The fans F rotates in close proximity to the finned tube bank T to circulate air around the tube bank and dissipate heat from the substances passed through the tubes. The temperature sensor S is sealably mounted in the compressor station discharge conduit 122 to sense the temperature of the substances after they have been passed through the tube bank T and cooled by the air circulated over these tubes. The temperature sensor S includes a well 124 extending into the discharge conduit 122 and a temperature sensitive member 126 slidably mounted with the well 124. The area 128 between the well 124 and temperature sensitive member 126 may be filled with lubricant or other material which allows the member 126 to slide longitudinally within the well 124 in response to temperature variations of the substances flowing through the discharge conduit 122. In response to an increase in temperature of the substances in conduit 122, the member 126 moves in the direction of arrow 130 and exerts a force on an arm 132 of a bleeder valve 134. The bleeder valve 134 is in fluid communication through conduit 136 with a metered air supply introduced through conduit 138. The amount of air from the metered air supply which is bled by bleeder valve 134 depends upon the positioning of arm 132, and, consequently, the amount of force exerted on arm 132 by temperature sensing member 126. As more force is exerted on arm 132 by member 126, less air is bled by bleeder valve 134. When the bleeder valve 134 does not bleed the entire air supply introduced through conduit 138, a pressure is exerted on a diaphragm 140 of diaphragm actuator 142 in the pump displacement control means D. The exact amount of pressure exerted on diaphragm 140 is, of course, dependent upon the amount of air bleed by bleeder valve 134. Since the functioning of the bleeder valve 135 is, in turn, dependent upon the operation of temperature sensor S, the pressure exerted on diaphragm 140 is directly proportional to the temperature of the substances flowing through discharge conduit 122. Stated another way, the temperature sensor S generates a cntrol signal corresponding to the temperature of the substances in discharge conduit 122, and the diaphragm actuator 142 is response to this temperature control signal.

,The pump displacement means D varies the fluid displacement of the pump by adjusting the angle of a swash plate 144 in response to the pressure exerted on diaphragm 140. An increase in the angle indicated generally by numeral 146 increases the fluid displacemment of the pump, and a decrease in that angle results in a decrease in the fluid displacement. To effectuate a change in the angle 146 of the swash plate 144, pump displacement control means D is provided with a stroking piston 148 engaging an upper cam reaction plate 150 of the swash plate 144 and a destroking piston 152 engaging a lower cam reaction plate 154 of the swash plate 144. The forces exerted by the pistons 148 and 152 on the respective cam surfaces 150 and 154 are controlled by pressures exerted on pistons 148 and 152 through conduit 156 and 158, respectively. The conduit 158 associated with destroking piston 152 is in constant fluid communication with a pump discharge conduit 160 so that the pressure exerted on destroking piston 152 is always substantially equal to the fluid pressure of the pump discharge. However, the pressure exerted through conduit 156 on stroking piston 148 is varied by a pressure control valve 161. Control valve 161 is a spool valve connected by a shaft 141 to diaphragm actuator 142 and is mounted between the stroking piston conduit 156 and the pump discharge conduit 160. A valve conduit 162 extends from the pump discharge conduit 160 to a midportion of valve 161, and a second valve conduit 164 branches from conduit 162 and extends into an end portion of pressure control valve 161. Additionally, pressure control valve 161 has a pressure escape conduit 166 on an opposing end portion of the valve for a purpose to be explained in more detail hereinbelow.

In FIG. 2, swash plate 144 is illustrated in a position where angle 146 is at its maximum and, consequently, the displacement of a pump is also at a maximum. Ears 168 and 170 of valve 161 are positioned to allow fluid communication between pump discharge conduit 160 and stroking piston conduit 156 through valve conduit 162. The spool is held in this position with the force exerted on car 170 by shaft 141 of actuator 142. In the position illustrated in FIG. 2, fluid pressure conveyed into valve 161 by conduit 162 acts on equal areas of ears 168 and 170 to produce balanced or equal and opposite forces. However, an unbalanced fluid pressure is exerted on ear 168 by fluid pressure conveyed through conduit 164. This unbalanced fluid pressure is countered, however, by the force exerted on the opposite side of the ear 170 by shaft 141. This countering force on ear 170 maintains spool valve 161 in the position shown so long as the temperature sensor S generates a control signal indicating that maximum pump fluid displacement is needed to meet the cooling requirements at the compressor station.

With spool valve in the position shown FIG. 2, the pressure exerted on stroking piston 152 is equal to the fluid pressure in pump discharge conduit 160. The fluid pressure in pump discharge conduit 160 is also exerted on stroking piston 148 through valve conduit 162 and stroking piston conduit 156. That is, ears 168 and 170 of spool valve 161 are in a position to allow fluid communication between the pump dischage conduit 160, valve conduit 162, and stroking piston conduit 156. However, the force exerted on cam reaction plate 150 by stroking piston 148 exceeds the force exerted on cam reaction plate 154 by destroking piston 152. This difference in the forces exerted on the respective cam reaction plates is due to the larger end area of stroking piston 48 and the spring bias force providing by a starter spring 172. The starter spring 172 ensures that the pump will deliver its maximum fluid displacement when the pump is initially brought into operation prior to the existence of fluid pressure in conduits 160, 158, 162 and 156. When the control signal from temperature sensor S causes a sufficient pressure to be exerted on ear 170 of spool valve 161, the spool valve will remain in the position illustrated in FIG. 2 and thus keep the pump operating at its full fluid displacement capability.

Figure 3:
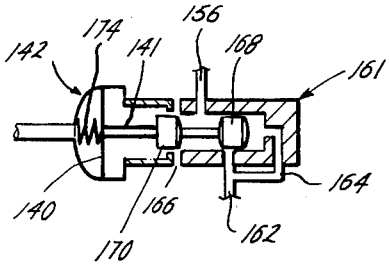
FIG. 3 is a schematic represenation of a portion of the pump displacement control apparatus in its displacement reducing position.

However, when the temperature of substances flowing through the compressor station discharge conduit 122 is sufficiently low, the control signal from temperature sensor S permits control valve 161 to move toward the position illustrated in FIG. 3 and reduce the fluid displacement by decreasing the angle 146 of swash plate 144. A decrease in temperature of the substances in conduit 122 causes less pressure to be exerted on diaphragm 140 in diaphragm actuator 142. This reduction in pressure on diaphragm 140 causes the force from a biasing spring 174 in diaphragm valve 142 to move the diaphragm and connected spool valve 161 toward the position illustrated in FIG. 3. In the position illustrated in FIG. 3, ear 168 on control valve 161 blocks the valve conduit 162 in communication with the pump discharge conduit 160. Accordingly, the fluid pressure in the pump discharge conduit 160 is not exerted on the stroking piston 148. Additionally, ear 170 of spool valve 161 is moved and no longer blocks escape passage 166 of the valve. Accordingly, a fluid flow passage from stroking piston conduit 156 to escape conduit 166 is provided through the control valve 161, and the fluid pressure on the stroking piston 148 is bled through the escape passageway 166. At the same time, destroking piston 152 remains in fluid communication with the pump discharge conduit 160 through conduit 158. As a result, the destroking piston 152 exerts a force on cam reaction plate 154 which is greater than the force exerted on cam reaction plate 150 by stroking piston 148. This difference in the forces exerted on the respective cam reaction plates causes a decrease in the swash plate angle 146 and a resultant decrease in the fluid displacement of the pump. Because the motors 14 and 16 of system A rotate the fans 10 and 12 at a rate corresponding to the fluid displacement of the pump, the decrease in angle 146 of swash plate 144 causes a corresponding decrease in the speed of rotation of fans 10 and 12. While FIG. 2 illustrates valve 161 in a position to maximize fluid displacement from the pump and FIG. 3 illustrates valve 161 in a position to minimize fluid displacement from the pump, it will be appreciated that valve 161 may take positions intermediate of the two extreme positions illustrated in the respective figures and thereby permit pump fluid displacements intermediate of the two extremes. Further, since the variation in the fluid displacement of the pump is responsive to the temperature of the substances in compressor station discharge conduit 122, variations in the speed of rotation of fans 10 and 12 correspond directly to the temperature of the substances cooled by the fans.

Figure 4:
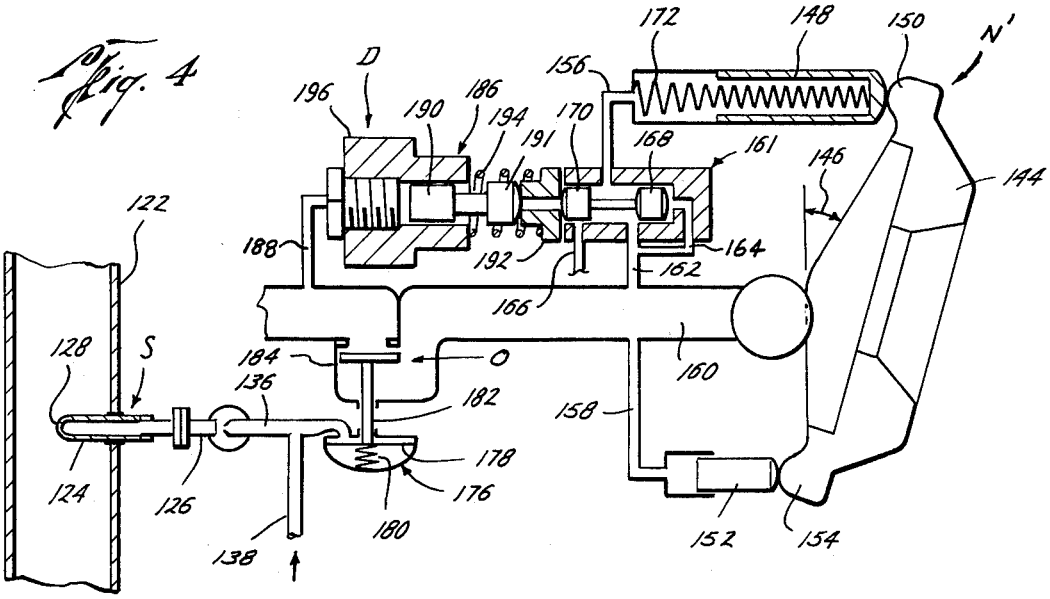
FIG. 4 is a schematic representation of a second embodiment of the temperature sensor and pumpd displacement control apparatus of the present invention.

A second embodiment of adjusting means N′ which is also responsive to temperature fluctuations in the substances flowing through the compressor station discharge conduit 122 is illustated in FIG. 4. Many of the elements of the adjustng means N′ illustrated in FIG. 4 are identical in structure and function to the elements of adjusting means N illustrated in FIGS. 2 and 3. Accordingly, like numerals are used in FIGS. 2, 3, and 4 to indicate corresponding elements. Indeed, the principal differences between the adjustng means N′ illustrated in FIG. 4 and adjustng means N of FIG. 2 are that the pump displacement control means D is responsive to a pressure differential across a variable orifice O mounted in the pump discharge conduit 160 and the control signal from temperature sensors S is used to regulate the variable orifice O. Air pressure in conduit 136 is conveyed to an orifice control valve 176 and exerts a pressure on a diaphragm 178 of the valve 176 to at least partially overcome the biasing force provided by a spring 180 in the valve 176. The diaphragm 178 is also mounted with a control arm 182 of a variable orifice valve, such as globe valve 184. It should be understood, however, that any suitable variable orifice valve may be used in lieu of the globe valve 184. However, in the specific embodiment illustrated in FIG. 4, the pressure exerted on diaphragm 178 control the positioning of valve member 182 and consequently controls the size of the orifice formed by the globe valve 184 in pump discharge conduit 160.

The pump displacement control means D includes a differential pressure operator 186 which acts on control valve 161 to control the pressures exerted on stroking piston 148 and destroking piston 152. The differential pressure operator is provided with a conduit 188 in communication with the pump discharge conduit 160 on the downstream side of varible orifice O. This conduit 188 provides fluid communication between the downstreams side of pump discharge conduit 160 and a piston 190 in the pressure differential operator 186. The piston 190 has a suitable extension 192 joined to ear 170 of control valve 161. In addition, the extension 192 of piston 190 has a recess 191 to mount a spring 194 which exerts a biasing force between an operating casing 196 and the extension 192. This spring bias causes the extension 192 to exert a force on the ear 170 of control valve 161. The spring biasing force is additive to the fluid pressure through conduit 188 so that the total force exerted on ear 170 of spool valve 161 is equal to the fluid pressure force communicated through conduit 188 and the spring biasing force.

In FIG. 4, pump displacement control D is illustrated in the position where the cam reaction plate angle 146 and, consequently, the fluid displacement of the pump are at a maximum. The variable orifice O has been opened to its maximum extent by the control signal from temperature sensor S, and the force exerted on ear 170 of spool valve 161 substantially equals the unbalanced fluid pressure exerted on the spool ear 168 through valve conduit 164. In the position illustrate, both stroking piston 148 and destroking piston 152 have equal fluid pressures exerted on them, and, due to the force from starter spring 172 and the greater area of stroking piston 148, a greater force is exerted on cam reaction plate 150 which causes cam plate angle 146 to be at its maximum.

However, when the temperature of the substances flowing through compressor discharge conduit 122 is sufficiently low, the temperature sensor S causes a lesser pressure to be exerted on diaphragm 178 of variable orifice control valve 176 and, accordingly, the biasing force from spring 180 causing the globe valve to close, at least partially. Due to the decrease in the orifice, the pressure conveyed to differential pressure operator 186 through conduit 188 is less than that conveyed when the variable orifice O is fully opened. As a result, the pressure exerted by extension 192 on ear 170 of control valve 161 is not sufficient to overcome the unbalance force exerted on ear 168. Since the forces on the control valve 161 are unbalanced, the spool valve 161 moves laterally toward the differential pressure operator 186 to a position substantially identical to that illustrated in FIG. 3. In this latter position, fluid pressure on stroking piston 148 is bled through valve escape passageway 166 so that the force exerted on cam reaction plate 154 by destroking piston 152 is greater than the force exerted on cam reaction plate 150 by stroking piston 148. As a result, the cam reaction plate angle 146 decreases and causes a decrease in the fluid displacement of the pump. As previously described, a corresponding decrease in the speed of rotation of fans 10 and 12 additionally results from this decrease in the fluid displacement of the pump.

It can be seen that with either embodiment of the adjusting means described above, the speed of rotation of the fans is controlled in direct response to the temperature of the substances cooled by the fans. This automatic adjusting of the fan speed ensures that the amount of air circulated by the fan is sufficient to accomplish the cooling requirements for the system. Yet, by regulating the speed of the fan rotation in response to the temperature changes of the cooled substance, most of the wasted energy associated with known fan drive systems which required adjustment of the pitch of the fan blades or spilling of generated horsepower to control fan speed is eliminated with the fan drive system A. Also, the speed at which the fans are driven is not substantially affected by changes in the speed of the compressor prime mover.

It should be appreciated that many deviations from the specific structure described above are possible without departing from the spirit of the invention set forth in the application. For example, system A has been described as a system principally designed for driving two or more fans F. The basic principles of the system A can, however, easily be used in circumstances where only one fan is to be driven. Additionally, the system described above is an open loop hydraulic system, but the system could also be a closed loop system.

The foregoing disclosure and description of the invention are illustrative explanatory thereof, and various changes in the size, shape, and materials as well as in the details of the illustrated construction may be made without departing from the spirit of the invention.

I claim:

1. A variable speed fan drive system comprising:

fan means for cooling a substance;

pump means for supplying operating fluid to operate said fan means;

motor means in fluid communication with said pump means to receive operating fluid therefrom for rotating said fan means at a speed corresponding to the fluid displacement of said pump means;

temperature sensing means for sensing the temperature of the substance cooled by said fan means and producing a pressure control signal corresponding to the temperature;

pump displacement control means operably connected between said temperature sensing means and said pump means for regulating the fluid displacement of said pump means in response to said control signal wherein said pump displacement means includes:

pump discharge conduit means for conveying operating fluid from said pump means to said motor means;

variable orifice means mounted in said pump discharge conduit means for forming an orifice of variable size in said discharge conduit means;

orifice control valve means operably connected to said temperature sensing means for receiving said control signal and regulating the size of the orifice of said variable orifice in response to said control signal; and differential pressure compensator means mounted with said discharge conduit means across said variable orifice means for detecting a fluid pressure differential across said variable orifice means and regulating the output of said pump means in response thereto, whereby the output of said pump means is regulated in response to the temperature of the substance cooled by said fan means.

* * * * *